US005551217A

United States Patent [19]

Huening et al.

[11] Patent Number: 5,551,217

[45] Date of Patent: Sep. 3, 1996

[54] LEAFLET INSERTER AND INTEGRATED PRODUCT BUCKET LOADER

[75] Inventors: William A. Huening, Union, Ky.; Richard E. Radigan, Cincinnati, Ohio

[73] Assignee: R. A. Jones & Company, Inc., Covington, Ky.

[21] Appl. No.: 308,919

[22] Filed: Sep. 20, 1994

[51] Int. Cl.[6] ..... B65B 35/20; B65B 61/20

[52] U.S. Cl. ..... 53/474; 53/252; 53/258; 53/261; 53/566

[58] Field of Search ..... 53/566, 258, 252, 53/251, 474, 473, 261

[56] References Cited

U.S. PATENT DOCUMENTS

| | | | |
|---|---|---|---|
| 2,116,607 | 5/1938 | Milmoe | 53/566 X |
| 2,644,625 | 7/1953 | Currivan | 53/252 |
| 2,662,355 | 12/1953 | Ross | 53/566 |
| 3,455,086 | 7/1969 | Bescript et al. | 53/252 X |
| 3,504,478 | 4/1970 | Dieter . | |
| 3,509,681 | 5/1970 | Sass | 53/252 X |
| 3,523,400 | 8/1970 | Daily | 53/117 |
| 3,688,414 | 9/1972 | Koehlinger et al. . | |
| 3,821,874 | 7/1974 | Jones | 53/252 |
| 3,982,382 | 9/1976 | Vogel | 53/252 |
| 4,211,054 | 7/1980 | Sramek | 53/252 X |
| 4,498,567 | 2/1985 | Aultz et al. | 53/77 |
| 4,526,564 | 7/1985 | Hughes | 53/252 X |
| 4,562,692 | 1/1986 | Scarpa et al. | 53/566 |
| 4,578,927 | 4/1986 | Scarpa et al. | 53/506 |
| 4,718,540 | 1/1988 | Greenwell | 198/627 |
| 4,817,779 | 4/1989 | Beck et al. | 198/365 |
| 4,874,067 | 10/1989 | Greenwell | 198/627 X |

*Primary Examiner*—James F. Coan
*Attorney, Agent, or Firm*—Wood, Herron & Evans, P.L.L.

[57] ABSTRACT

An improved leaflet inserter includes a series of adjacent leaflet trays carried by a conveyor along side of a cartoner and each tray includes a leaflet pusher movable in a slot transverse to the direction of the conveyor to push a leaflet placed in the tray out the side of the tray and into a synchronized carton or into a product bucket which is moving along side of the tray. In an embodiment of a leaflet tray, the leaflet pusher includes a downwardly extending cam pin which engages an adjustable cam positioned beneath the trays which urges the cam pin to slide the leaflet pusher transversely across the tray. In another aspect of the present invention, an integrated product bucket loader includes a plurality of product load receiving buckets mounted on a conveyor and each bucket has an integral, movable end wall which is slidably mounted on the bucket for movement across the width of the bucket. The end wall moves to one end and expands the bucket capacity to allow sequential loading of a plurality of products, and once filled, moves to the other end to push the product load out of the bucket and into a carton.

31 Claims, 6 Drawing Sheets

LEAFLET INSERTER AND INTEGRATED PRODUCT BUCKET LOADER

FIELD OF THE INVENTION

This invention relates generally to apparatus for inserting items into cartons and more particularly to apparatus for inserting leaflets into cartons. In another of its aspects, the invention also relates to apparatus for building loads for insertion into cartons.

BACKGROUND OF THE INVENTION

Cartoners are useful for placing various goods in packaging cartons. A cartoner feeds flat, folded carton blanks from a stack in sequence onto a conveyor, erects each of the blanks into a carton and presents the cartons at a loading station to be filled either manually or automatically with a product load. The cartoner usually conveys the cartons in a linear path along a packaging line. A product bucket conveyor conveys product loads to the loading station to be inserted into the cartons before they are sealed. Typically, the bucket conveyor conveys the product loads in a linear product path parallel and adjacent to the cartoner. The motion of the erected cartons and product loads is synchronized for product insertion by means of a barrel loader having extensible pushers moving in transverse orientation to the machine direction and selectively extensible laterally to push product loads from conveyor buckets into respective synchronized carton.

In addition to inserting product loads into the cartons, it is often desirable to include a product coupon or a leaflet containing written material such as the contents of the product or instructions for using the product. Accordingly, leaflet inserting equipment must be positioned in the packaging line with the cartoner and the barrel loader such that the leaflets are finally included in the filled cartons. The leaflets are inserted into cartons either prior to the insertion of the product loads along with the product loads or thereafter and are inserted into product buckets for later carton insertion. Existing leaflet inserting devices are complicated pieces of equipment which utilize many intricate parts including various gears and chains arranged at various height levels with respect to the cartoner. Moreover, many of these leaflet inserters are expensive to assemble and maintain in proper working condition, often needing constant adjustment. Still further, because of the intricacies of the existing leaflet inserter devices and their continuous engagement with the cartoner, they often add additional time to the packaging process which translates into increased costs in the packaging of particular goods. Accordingly, there is a need for a leaflet inserter which operates with a minimal number of intricate parts and which is readily assembled and easily and inexpensively maintained in proper working condition. Furthermore, there is a need for a leaflet inserter which does not substantially slow down the packaging process as the leaflet is inserted into a carton.

Another problem encountered in the packaging of product loads into a carton is the necessity of having various different pieces of conveying and loading equipment, all of which must cooperate in order to properly package the goods. A conventional way of loading cartons has been to utilize a product bucket conveyor which receives individual product loads and carries them along a product path next to a respective carton. At a predetermined position along the product path, the plunger arm of an adjacent barrel loader on one side of the bucket conveyor engages the product load and pushes the product load from the product bucket into a synchronized carton on the other side of the bucket conveyor. The various plunger arms and pushing mechanisms of the barrel loader must be synchronized to extend into the product buckets as they pass the loader to eject the product load. The pushing mechanism must then withdraw to eventually realign with another bucket following behind the emptied product buckets. An example of such a barrel loader is shown in U.S. Pat. No. 4,578,927 which is commonly owned with the present application.

Such a configuration yields a machine footprint on a factory floor which is three units wide. That is, at a position along the packaging line, the cartoner, bucket conveyor, and barrel loader are placed side by side one another to operate in a timed sequence. As may be appreciated, such a configuration occupies a substantial amount of precious space on a factory floor.

Accordingly, it is desirable to provide an improved cartoner while eliminating the need for the typical barrel loader.

When each bucket is to contain a plurality of product items, the loading of the buckets becomes complicated and often requires further complex machinery to produce a full, correctly oriented load for each product bucket. If each carton is to eventually contain a plurality of items, such as for example, pouches of drink mix or other individual items, a full load of such pouches must be deposited in the bucket. If done one at a time, the pouches could tip over and interfere with incoming pouches, and the homogeneity of the product load could otherwise be disturbed.

Therefore, there is a need for an improved cartoner requiring a smaller factory floor footprint and which simplifies the packaging process while maintaining the integrity of the loading procedure without increasing the necessary packaging time. Still further, there is a need for an improved cartoner which reduces the complicated interaction between various equipment lines.

SUMMARY OF THE INVENTION

To these ends, the invention contemplates an improved leaflet inserter and an improved bucket conveyor which eliminates the necessity for additional carton loading apparatus such as a barrel loader. According to one embodiment of the invention, a leaflet inserter is disposed alongside a cartoner to insert leaflets into product cartons as the cartons are moved along a predetermined packaging path. The leaflet insertion of the present invention includes a series of adjacent leaflet trays carried by a conveyor in a linear direction alongside a cartoner. Each tray is provided with a leaflet pusher movable in a slot transverse to the machine directions to push a leaflet placed in the tray out the side of the tray and into a synchronized carton or into a product bucket which is moving alongside the tray. At a predetermined position along the leaflet tray conveyor, a leaflet loader feeds a leaflet in a machine direction onto the tray at a position between the pusher and the adjacent cartoner so the pusher can effectively transfer the leaflet into the carton or product bucket.

The leaflet pusher includes a downwardly extending cam follower or pin. During operation, the leaflet tray receives a leaflet from the loader and the leaflet pusher is positioned at one side of the tray. As a tray moves along the conveyor, the pin engages an adjustable cam positioned beneath the trays along the conveyor track. The moving trays urge the cam pins along the cam to slide the leaflet pushers transversely across the tray to eject the leaflet from the other side of the tray into a carton or a product bucket. After insertion of the leaflet, the trays wrap around the bottom of the conveyor and are moved in a return direction opposite the packaging direction. During the return, the pin of the leaflet pusher engages another return cam and is slid back to the first end of the tray. The tray is again fed by the leaflet loader and receives another leaflet to repeat the process.

In a preferred embodiment of the present invention, the leaflet loader, which may also constitute the discharge of a leaflet folder apparatus, includes a plurality of guide fingers with opposed rotating belts which guide a leaflet downwardly into a position to be taken by a tray. Each tray has slots at a rear wall thereof which receive the guide fingers as the tray passes beneath the leaflet loader. The slots define upstanding tray fingers which strip the leaflet from the folder discharge or loader.

The cam mechanism includes an elongated cam positioned beneath the tray conveyor at a predetermined position along the conveyor to receive the leaflet pusher pin. The pin follows the cam and moves the leaflet pusher across the tray. The cam is angled with respect to the direction of movement of the trays and moves the leaflet pushers from one side of the tray to the other side to effectively insert the leaflet into a carton or product bucket. The angle of the cam is preferably adjustable to allow for insertion of various length leaflets as the tray moves along the conveyor. The leaflet pusher slides in a guide slot formed in the trays and is readily removable from the tray for quick repair or replacement by means of offset plunges and the pusher itself.

The present invention thereby provides a simple, efficient leaflet inserter which is inexpensively manufactured, assembled, and maintained. Furthermore, the leaflet inserter is efficient and operates to continually insert leaflets into product cartons or buckets without adding a substantial amount of time to the packaging process.

In accordance with another aspect of the present invention, an integrated product bucket loader is disclosed which is utilized with a cartoner to carry loads of a product and eject the product loads into cartons without the necessity of a separate barrel loader or other loading devices. More specifically, the integrated product bucket loader includes a plurality of product load receiving buckets mounted on a conveyor to move in a predominately linear direction next to a carton. Each bucket has an integral, movable end wall which is slidably mounted on the bucket for movement across the width of the bucket. The end wall is movable toward one end to expand the bucket capacity as the bucket accepts a product load. The movable end wall thus allows the sequential loading of a plurality of products into a single bucket while at the same time supporting the end most item to keep the entire building load in a desired configuration or orientation. In that way, loads of multiple products such as pouches can be built in the buckets of the bucket conveyor.

Once the bucket has been filled with the desired product load, it is moved adjacent a carton, and a cam mechanism engages the movable end wall and slides it to the other end of the bucket to push the product load out of the bucket and into the carton. That is, as the bucket moves along the conveyor, the movable end wall is first moved in one direction to expand the capacity of the bucket and receive a product load, and facilitate load building, and is subsequently moved in an opposite direction to reduce the capacity of the bucket and to effectively eject the product load out of the bucket and into a carton. The separate barrel loader, previously used in cartoners, is eliminated.

In one embodiment of the integrated product bucket loader, the movable end wall of the bucket includes a cam following pin and is slidable within a longitudinal slot formed in the bucket. The cam following pin extends vertically downwardly below the bucket. The cam mechanism includes a first elongated cam which is positioned at a predetermined position beneath the buckets, and the end wall pin engages the first cam to move the end wall to expand the bucket as the bucket accepts a product load. A second cam is oriented in a direction opposite the first cam track and is positioned further along the conveyor at a position near a cartoner carrying open product cartons. The second cam engages the end wall pin and moves the end wall in an opposite direction to eject the product load into a carton. Each cam may be adjusted in angle with respect to the direction of the conveyor in order to vary the rate at which the product bucket capacity is expanded and the rate at which the product load is subsequently ejected. The end wall is readily removable from the tray for quick repairs or replacement. The integrated movable end wall of the product bucket loader eliminates the necessity of having a separate barrel loader adjacent to the product buckets to push the product loads into cartons.

Accordingly, the factory floor footprint of the present invention utilized in conjunction with a cartoner is substantially reduced from the footprint of conventional equipment which requires a cartoner, a conveyor with product buckets and a separate barrel loader all aligned and synchronized to package the product. In addition to freeing up valuable factory floor space, the integrated product bucket loader of the present invention eliminates the need for an expensive piece of equipment, i.e., the barrel loader, and greatly simplifies the product bucket loading and unloading processes in the overall packaging scheme. Product load building is simplified.

Other advantages and features of the present invention will be more readily apparent from the Brief Description of the Drawings and the Detailed Description of the Invention given hereinbelow.

DETAILED DESCRIPTION OF THE INVENTION

Figure 1:
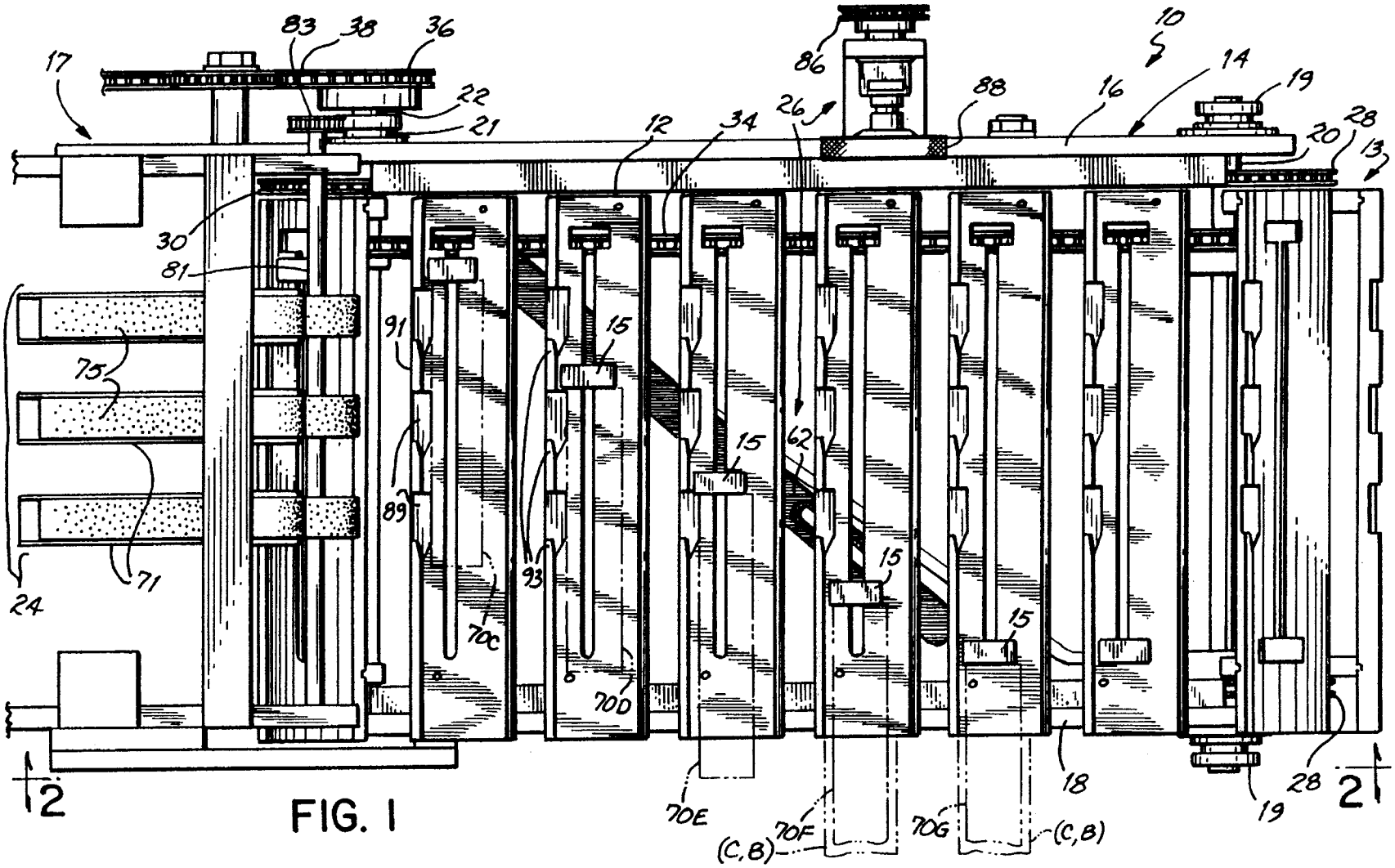
FIG. 1 is a plan view of a leaflet inserter according to the invention.

As shown in FIG. 1, the leaflet inserting apparatus or leaflet inserter 10 of the present invention utilizes a plurality of spaced leaflet trays 12 and includes a conveyor 14 which carries and moves the trays 12 in a generally linear packaging direction. The leaflet inserter also includes a leaflet folder or folder discharge 24 which loads leaflets into the trays 12 and a cam mechanism 26 which engages leaflet pushers 15 located in each of the trays 12 to move the leaflet pushers 15 and insert leaflet into product cartons or buckets.

Leaflet Tray Conveyor

Accordingly, the leaflet inserter 10 is preferably positioned next to a cartoner which moves product cartons or buckets, for example, in synchronized movement with the trays 12. The construction and operation of the leaflet tray conveyor 14, leaflet tray 12, leaflet folder 24, cam mechanism 26, and the overall operation of the leaflet inserter are described in greater detail herein below. Referring to FIG. 1, leaflet tray conveyor 14 includes side rails 16, 18 which support there between a forward conveyor shaft 20 and rearward conveyor shaft 22 (See FIG. 3). The leaflet loading mechanism or leaflet folder 24 is also supported by the conveyor 14 proximate the rearward end 17 of the conveyor. Forward shaft 20 carries a pair of opposing sprockets 28, each sprocket 28 being positioned proximate one of the opposing ends of forward shaft 20 adjacent to one of the side rails .16, 18. Rearward shaft 22 includes a pair of sprockets 30 similarly situated on shaft 22 as the sprockets 28 are on shaft 20. Shafts 20 and 22 extend generally parallel each other and perpendicular to the side rails 16, 18. Forward shaft 20 is located proximate the front end 13 of the conveyor, whole rearward shaft 22 is proximate rear end 17. Shafts 20, 22 are affixed to the side rails 16, 18 by appropriate bearing structures 19, 21, respectively, for rotational movement. Shafts 20, 22 and sprockets 28, 30 rotate and drive conveyor chains 34 in a longitudinal direction along conveyor 14. The chain 34 extends between respective pairs of sprocket 28, 30 on each side the conveyor 14.

Figure 3:
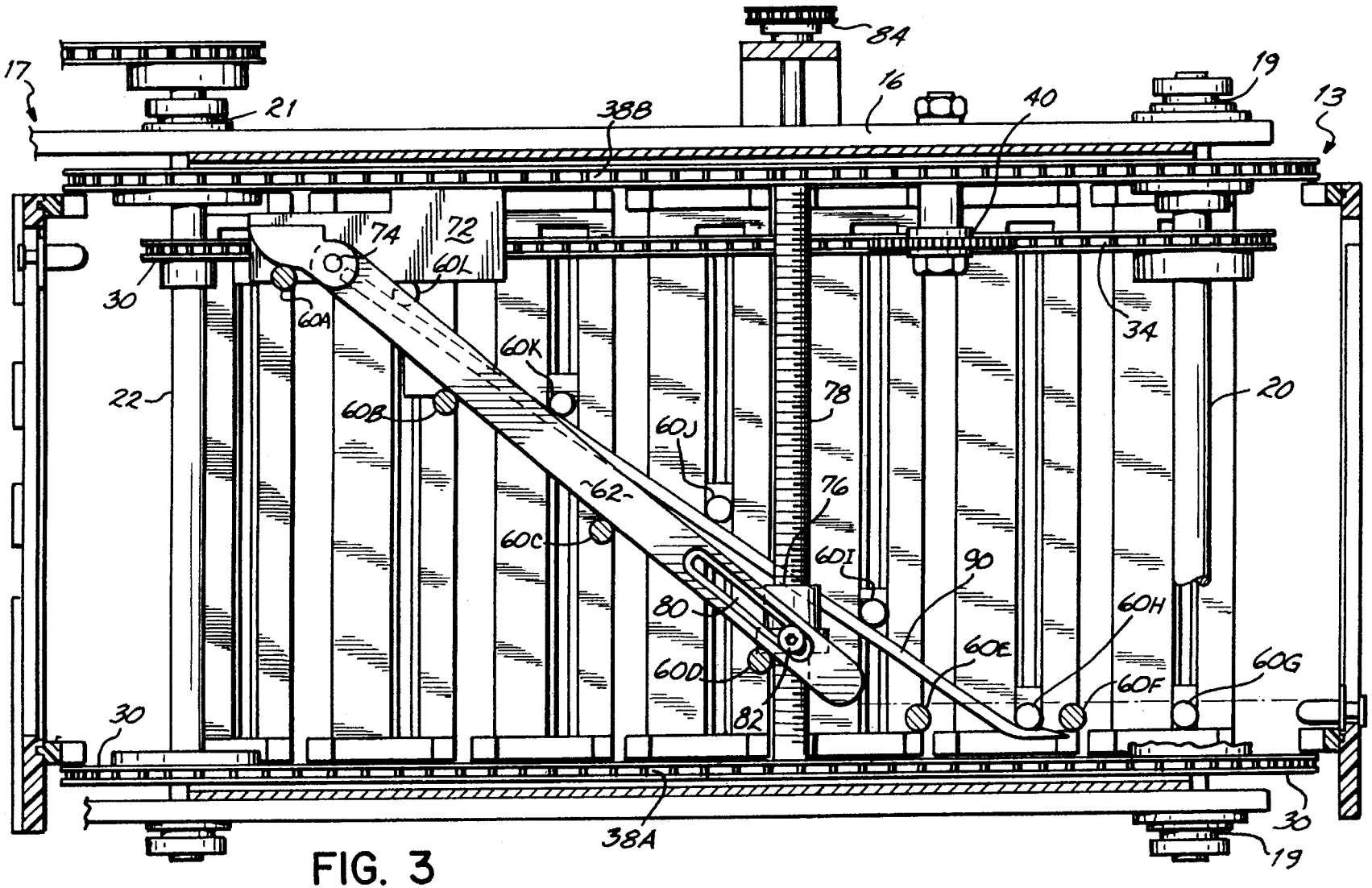
FIG. 3 is a cross-sectional view taken along lines 3—3 of FIG. 2 and illustrating the pusher cam.

Rearward shaft 22 functions as the drive shaft for the conveyor 14 and is coupled to drive sprocket 36 which, in turn, is connected by a drive chain 38 and appropriate chain and sprocket linkages (not shown) to an appropriate driving system or motor (not shown). Rotation of sprocket 36 drives shaft 22 and thereby drives the conveyor chain 34 continuously from the rear end 17 to the front end 13 of the conveyor. Conveyor 14 is utilized to move a plurality of leaflet trays 12 around a continuous path for continuous insertion of leaflets into product cartons. Referring to FIG. 3, one or more idler sprockets 40 might be utilized for a more smooth operation of the conveyor 14.

Figure 2:
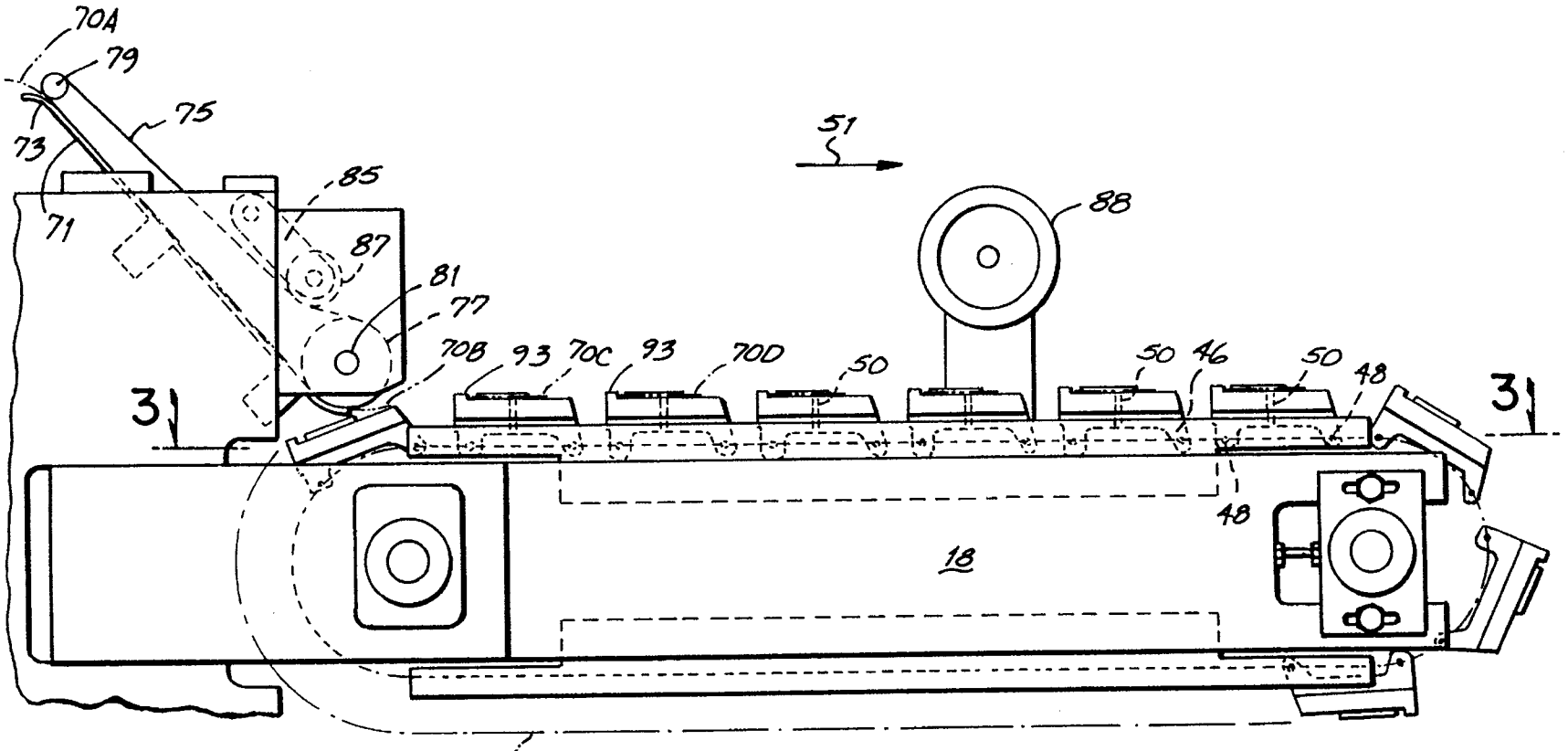
FIG. 2 is an elevational illustration taken along lines 2—2 of FIG. 1.

Referring now to FIG. 2, conveyor chain 34 moves in a path around the sprockets 28, 30 and shaft 20, 22 in a clockwise motion with respect to FIG. 2. The individual conveyor chains, designated as 38A and 38B, support opposite end of the trays 12 (see FIG. 3). A plurality of spaced-apart creeper links 46 are positioned around each chain 38A, 38B. FIG. 2 shows the creeper links 46 associated with chain 38A, and chain 38B (not illustrated in FIG. 2) contains similar creeper links 46. Each creeper link 46 on chain 38A is paired up with a respective creeper link on chain 38B to support opposite ends of the leaflet trays 12. The creeper links 46 are connected to the conveyor chains 38A and 38B by extension pins 48, and each leaflet tray 12 is connected to its respective creeper links 46 by threaded bolts 50. Thereby, when conveyor chains 38 move, they move each leaflet tray 12 in a machine direction or a packaging direction indicated by arrow 51. The trays move along the top of the conveyor 14 and wrap around at the front end 13 to move along the bottom of conveyor 14 and back to the rear end 17 of the conveyor where the trays 12 again wrap around to move along the top of the conveyor. (See FIG. 2)

Leaflet Trays

Figure 4A:
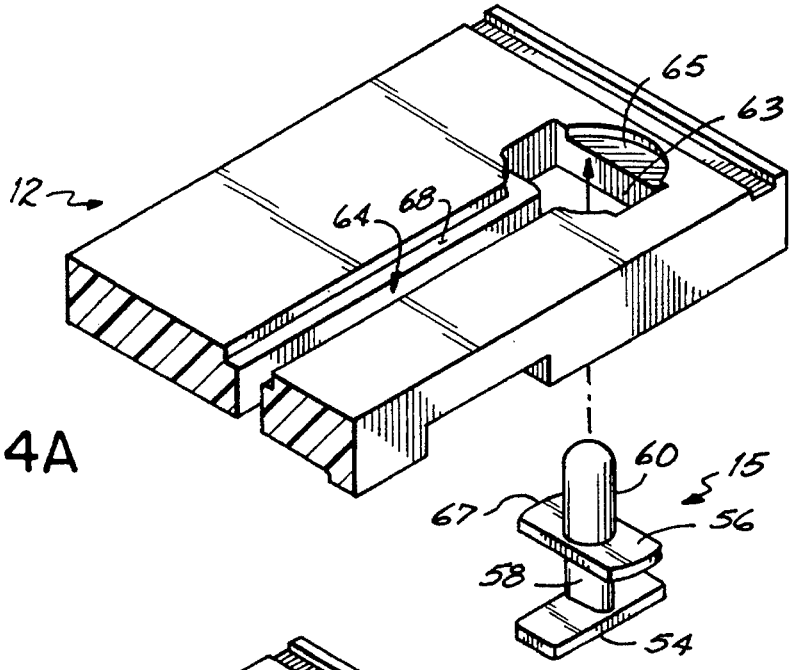
FIG. 4A is a disassembled perspective view of the underside of a leaflet tray and pusher.
Figure 4B:
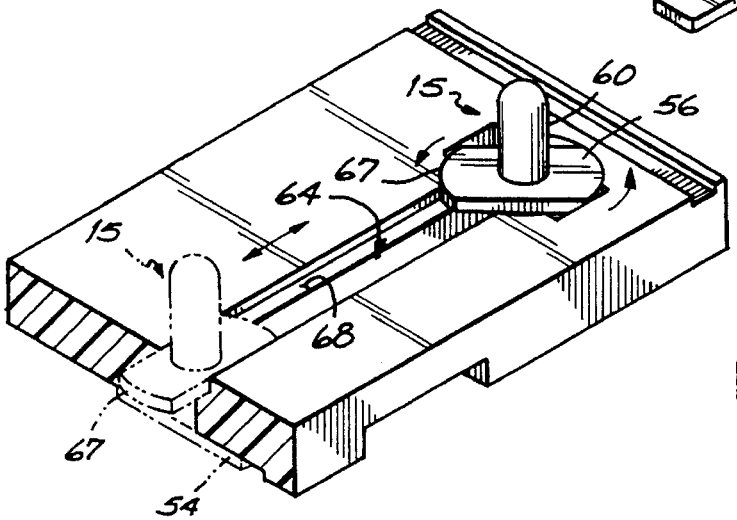
FIG. 4B is a perspective view of the underside of the leaflet tray and assembled leaflet pusher.

Each leaflet tray 12 includes a leaflet pusher 15 which is slidably mounted on tray 12 for movement across the tray in a direction generally transverse to the packaging direction 51. FIGS. 4A and 4B illustrate the bottom side of a portion of a tray 12. The leaflet pusher 15 includes an upper or pusher lug 54 and a lower or lock lug 56 which are spaced apart from one another by the pusher body 58. Extending vertically downwardly from the lock lug 56 is a cam following pin 60 which contacts an elongated cam 62 which is part of the cam mechanism 26. Cam 62 moves pin 60 and moves the leaflet pusher 15 across the leaflet tray 12. FIGS. 4A and 4B are views of the underside of the leaflet tray 12, and therefore, they show the cam following pin extending vertically upwardly.

Leaflet pusher 15 is guided on the leaflet trays 12 by a guide slot 64 which extends along a large portion of the length of tray 12 (See FIGS. 1 and 3).

An aperture 63 is formed in tray 12 at one end of guide slot 64. Aperture 63 is generally rectangular and is configured to receive the rectangular lock lug 56 of leaflet pusher 15 for rapid and simple coupling and uncoupling of the leaflet pusher 15 to the tray 12. As illustrated in FIG. 4A, lock lug 56 slides through aperture 63 and a circular shoulder 65 formed around aperture 63 allows rotation of rectangular lock lug 56 so that the lock lug 56 may be aligned with slot 64. The ends 67 of lock lug 56 are preferably rounded for easy rotation around shoulder 65. When the leaflet pusher 15 is rotated and lock lug 56 is aligned with guide slot 64, the leaflet pusher may move within slot 64 as illustrated in FIG. 4B.

A shoulder 68 is formed on both sides of guide slot 64. Pusher body 58 is configured to slide within slot 64, however, the lock lug 56 is dimensioned in width to ride on shoulder 68 as the leaflet pusher moves in slot 64 as illustrated in FIG. 4B. This holds the pusher 15 secure on the tray 12. Pusher lug 54 is elongated and is oriented generally perpendicular to the lock lug 56. When leaflet pusher 15 is positioned to move within slot 64, the pusher lug 54 is oriented perpendicular to slot 64. As shown in FIG. 1, pusher lug 54 provides a wide pushing front along tray 12 to push a leaflet out of tray 12 and into an adjacent product bucket or into a carton.

As illustrated in FIG. 1, conveyor 14 moves the leaflet trays in the packaging direction 51 and the leaflet pusher 15 advances across tray 12 under the direction of cam 62 to push a leaflet 70 out of the tray 12. Leaflet pusher 15 is moved by cam 62 acting against cam following pin 60.

Leaflet Loader

Before leaflets 70 can be inserted into product buckets, for example, the leaflets must be loaded on to the trays 12. Leaflets 70 are placed in leaflet trays 12 by a leaflet folder 24 positioned proximate the rear end 17 of conveyor 14. As illustrated in FIG. 1, leaflet folder 24 includes three guide arms 71 which are sloped downwardly from above the conveyor 14 to the level of the leaflet trays 12 (see FIG. 2). A leaflet 70A is placed on the guide fingers at the upper end 73 of the fingers and moves down the guide arm 71 to be placed in a leaflet tray as indicated by leaflet 70B in FIG. 2. Adjacent each guide arm 71 is a driven belt 75 which has a section generally co-extensive with the guide arm 71. Belt 75 is stretched between a driver pulley 77 and a tension wheel 79 and rotates in a generally counter-clockwise direction as referenced to FIG. 2 to pull the leaflet 70A downwardly over the guide arm 71 to the position of leaflet 70B. Preferably, the driver pulleys 77 of each arm 71 are connected on a common axle 81 to a sprocket 83. The sprocket 83 is linked to the drive axle 22 of the conveyor 14 by means not shown for synchronized movement of the leaflets over the guide arm 71 with respect to the moving leaflet trays 12. Referring to FIG. 2, a spring biased tensioner arm 85 may be utilized with each belt 75 to maintain tension on the belts, such as by a tension wheel 87.

As illustrated in FIG. 1, each leaflet tray 12 includes three grooves 89 which are formed in a rearward end 91 of each tray. The grooves 89 are preferably spaced along the rearward end 91 to coincide with each guide arm 71 and belt 75. The grooves 89 define upperly extending tray fingers 93 in each of the leaflet trays 12. Tray fingers 93 operate to strip the leaflet 70 from the guide arm 71 as the trays 12 pass underneath the leaflet loader as shown in FIG. 2, specifically tray 12A, strips leaflet 70B from leaflet folder 24. Thereby, leaflets are deposited into the trays 12 to be inserted into adjacent product cartons by leaflet pushers 15 which are moved by the cam structure 26.

Cam

Cam apparatus 26 includes cam 62 which is angled with respect to the packaging direction 51 such that when leaflet trays 12 are moved into the packaging direction 51, the cam 62 guides cam following pin 60 in the leaflet pusher 15 across tray 12 in a direction transverse to the packaging direction 51. As illustrated in FIGS. 1 and 3, cam 62 is positioned at the top of conveyor 14 just beneath the moving leaflet trays 12. Cam 62 slides leaflet pusher 15 in timed sequence with the movement of trays 12 adjacent a product carton. Cam 62 moves the leaflet pusher to the end of tray 12 so that the leaflet 70 is inserted into a product carton (not shown) before the leaflet tray wraps around the front end 13 of conveyor 14 and travels along the bottom half of the conveyor to the rear end 17 of the conveyor.

The angle of cam 62 with respect to the packaging direction 51 may be adjusted in order to adjust the timing sequence of the leaflet pusher 15 and the movement of leaflet tray 12 or to adjust for leaflets of varying length. Referring now to FIG. 3, a top view of leaflet inserter is shown just below the top set of trays to expose the cam 62. Cam 62 is pivotally mounted to a cam mounting plate 72 at a pivot point 74. Cam mounting plate 72 is appropriately affixed to the side rail 16 for rigid support. The end of cam 62 opposite pivot point 74 is coupled to a threaded collar 76 which moves along an adjustment screw 78 which extends perpendicular the packaging direction 51 and generally parallel the leaflet trays 12. Cam 62 has a slot 80 formed therein and is connected to collar 76 by a shoulder screw 82. Collar 76 moves along the length of adjustment screw 78 when the adjustment screw is rotated, and thereby pivots cam 62 about pivot point 74 and varies the angle of cam 62 with respect to the packaging direction 51 and movement of trays 12.

For adjusting the angle of cam 62, adjustment screw 78 is connected to a lower sprocket 84 which, in turn, is connected to an upper sprocket 86, such as by a chain or other appropriate linkage. Upper sprocket 86 is connected to an adjustable hand wheel 88 (see FIG. 2) which may be rotated to rotate sprockets 84, 86 and the adjustment screw 78. Slot 80 formed in the end of cam 62 allows angular and pivoting movement of cam 62 as collar 76 moves forward or away from the hand wheel 88 as the adjustment screw 78 is turned.

Positioned below cam 62 and generally toward the bottom of conveyor 14 is an elongated linear guide 90. Guide 90 directs leaflet pushers 15 of the trays 12 back across the trays to their original positions so that the trays are again ready to receive leaflets. Referring to FIG. 3, guide 90 is hard mounted to conveyor 14 such as by an appropriate bracket (not shown). Guide 90 receives the cam following pins 60 of the leaflet pushers 15 and thereby directs the leaflet pushers across the trays toward opening 63 as the trays 12 return along the bottom of the conveyor 14 in a direction opposite the packaging direction 51. When the trays 12 reach the conveyor rear end 17, the leaflet pushers 15 are again at their originating positions and ready to receive a leaflet 70 (see FIG. 1).

FIG. 3 illustrates the progression of the leaflet pushers 15 as the trays 12 move along the conveyor 14. Respective cam following pins of each leaflet pusher designated as 60A–60L. As a tray 12 begins at the rear end 17 of conveyor 14, the leaflet pusher is in a position designated by pin 60A. The pins 60 engage cam 62 and as the trays 12 move in the packaging direction 51, the pins 60B, 60C, and 60D illustrate the transverse progression of the leaflet pushers 15 across the trays 12. When the leaflets 70 have been inserted, the pushers 15 will be at their forwardmost positions as illustrated by numerals 60E and 60F. The trays 12 then wrap around to the bottom of conveyor 14 and begin their return progression opposite packaging direction 51 as illustrated by numerals 60G, 60H. The pins 60 of the return tray traps engage guide 90 then slide the pins 60 and leaflet pushers 15 backward in the trays 12 to their originating positions. The return progression of the leaflet pushers is illustrated by pins 60H, 60I, 60J, 60K, and 60L.

Operation of Leaflet Inserter

In summarizing the operation of the above-described leaflet loader 10, the plurality of leaflet trays 12 are moved by a conveyor 14 in continuous motion, preferably next to a cartoner which moves open product buckets or cartons in timed synchronization with the leaflet trays 12. For reference, the trays 12 originate their movement at the rearward end 17 of the conveyor 14 proximate leaflet folder 24. Leaflets 70 are inserted onto the leaflet guide arm 71 as shown in FIG. 2 and are carried by moving belts 75 down to the bottom of each finger 71 to be engaged by tray fingers 91 and stripped from the guide arm 71 of the leaflet loader.

As the leaflet trays 12 move with the leaflets 70, cam 62 engages pins 60 of the leaflet pusher 15 and progressively pushes the leaflets 70 transversely across the tray as illustrated by leaflets 70C, 70D, 70E, 70F AND 70G of FIG. 1. The leaflet pusher 15 moves across tray 12 to insert the leaflet into an adjacent product carton. The leaflet tray 12 is then wrapped around at the front end 15 of conveyor 14 and returns rearwardly (see FIG. 2). On the return, the cam following pins 60 of the leaflet pushers 15 engage guide 90 which thereby returns the pins 60 leaflet pushers 15 back across each tray 12 to prepare the trays to again receive a leaflet. Movement of the leaflet pushers is in a synchronized time sequence with the driven belts 75 of the leaflet loader with the movement of the leaflet trays 12, and also preferably with the adjacent moving product cartons, which are moved by a cartoner in sequence with the leaflet trays 12. Leaflet inserter 10 operates to continually insert leaflets into adjacent product cartons. Cam 62 is adjustable to increase or decrease the rate of movement of the leaflet pushers across the trays as the trays move along the conveyor to thereby provide adjustment of the leaflet insertion rate with respect to the moving product cartons.

Integrated Bucket Loader

Figure 5:
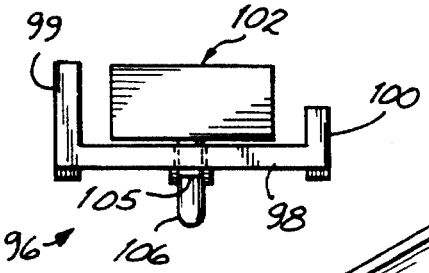
FIG. 5 is an end view of an integrated product bucket according to the invention.
Figure 6:
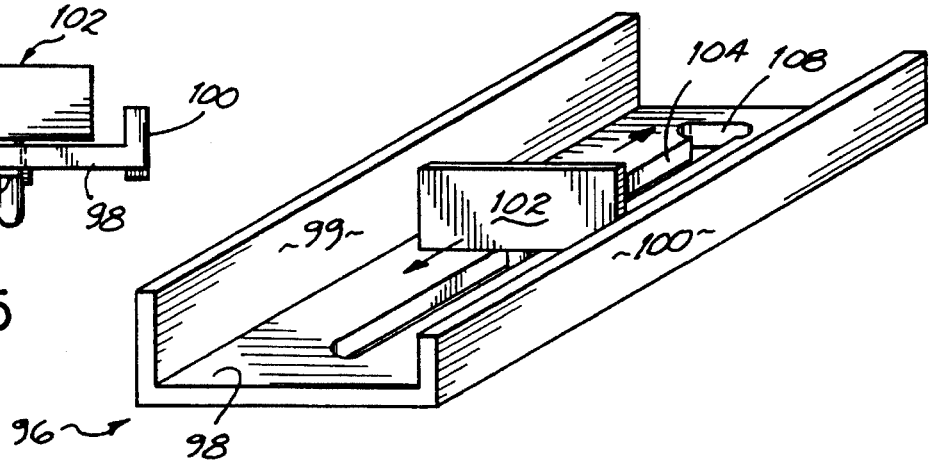
FIG. 6 is a perspective view of the integrated product bucket of FIG. 5.

In accordance with another aspect of the present invention, an integrated product bucket loader is disclosed which is utilized with a cartoner for building loads, for carrying loads to a load station and for inserting the product loads into cartons without the necessity of a separate barrel loader. Referring to FIGS. 5 and 6, a product load receiving bucket 96 is illustrated having a bottom 98 and sidewalls 99, 100. The product load receiving bucket 96 includes an integrated movable end wall 102, which is slidably mounted on bucket 96 for movement along the length of the bucket as illustrated in FIG. 6. In one embodiment of the invention, the end wall 102 is mounted on a pin 106 movable within a guide slot 104 formed at the bottom 98 of the bucket. As illustrated in FIG. 5, movable end wall 102 includes a lock lug 105 and a downwardly extending cam following pin 106 which are generally similar in construction and operation to the lock lug and cam following pin of the leaflet pusher in the above-described leaflet inserter. The lock lug fits within an opening 108 formed at one end of slot 104 and is rotated to seat within slot 104 and secure end wall 102 to the bucket 96. Thus, in accordance with the principles of the present invention, the movable end wall 102 may be quickly and easily installed and removed from bucket 96 by moving the end wall 102 to opening 108 and rotating the end wall 102.

In a preferred embodiment of the integrated bucket loader, a plurality of product buckets 96 are positioned on a moving conveyor such as the conveyor 14 described herein above with respect to the leaflet inserter or some other suitable conveyor. Movable end wall 102 moves across the product bucket 96 to accept a product load and carry the product load to a cartoner, and to subsequently eject the load from the bucket into an adjacent product carton. Integrated movable end wall 102 eliminates the need for a separate barrel loader device for ejecting the product loads. Therefore, a barrel loader device does not have to be positioned adjacent to product bucket conveyor on a factory floor which saves valuable space on the factory floor. Moreover, a product load of a plurality of items can be built into the expandable bucket, its capacity growing as the bucket is filling, by virtue of the movable end wall 102.

Figure 7:
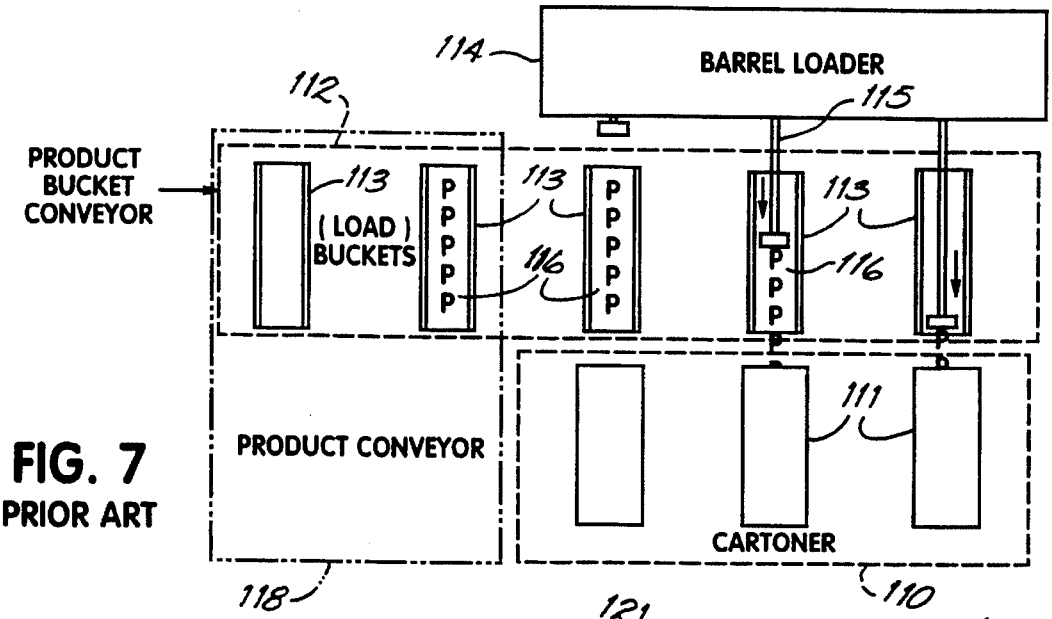
FIG. 7 PRIOR ART
FIG. 7 is a diagrammatic plan view of a prior art cartoning assembly including barrel loader, bucket conveyor, product conveyor and cartoner.

FIG. 7 illustrates a conventional packaging line, including a cartoner 110 with individual product cartons 111, product bucket conveyor 112 with individual product buckets 113 moving in sequence with the cartons 111 and a barrel loader 114 with extensible plungers 115 which also move in time sequence with the product buckets 113 and cartons 111 so that product loads 116 may be ejected from a product bucket into a carton. More specifically, a product conveyor 118 places individual product loads 116 into the buckets 113 of the product bucket conveyor 112. The product loads 116 might be individual packets of a substance which are placed adjacent to one another in a sideways stack as shown in FIG. 7, and the product loader must be configured to load the bucket without disorientation of the individual products of the full load. For example, a fully assembled load is typically dropped into a product bucket. The product bucket conveyor 112 moves the product buckets 113 and product loads 116 to a position adjacent cartoner 110. In various positions along the length of the cartoner 110, the extensible plungers 115 of the barrel loader 114 project into the product buckets 113 to eject the product loads 116 into the adjacent cartons 111. As illustrated, the barrel loader 114, product bucket conveyor 112 and cartoner 110 must be aligned so that plunger 115 may eject the product load 116 into an adjacent carton 111. In addition to occupying valuable floor space, the barrel loader also adds complexity to the packaging system because of the alignment an synchronization that is necessary.

Figure 8:
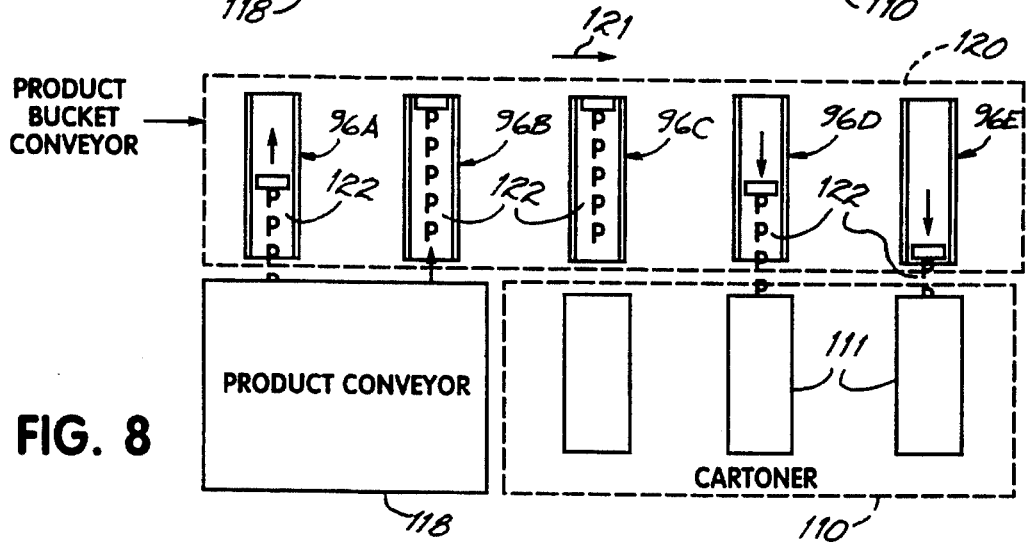
FIG. 8 is a diagrammatic plan view of an integrated bucket loader and cartoner according to the invention.

As illustrated in FIG. 8, the present integrated bucket loader of the invention eliminates the need for a separate barrel loader frees up valuable factory floor space, and reduces the complexity of the packaging system. Product conveyor 118 and cartoner 110 are positioned along the integrated product bucket loader 120 of the present invention. The integrated product bucket loader 120 moves the individual product load receiving buckets 96 in a generally linear machine or packaging direction indicated by reference arrow 121. The buckets 96 proceed past a product conveyor 112 where they receive a product load 122. The integrated movable end wall 102 slides in a rearward direction in the buckets 96 as the products are sequentially introduced into the buckets to form loads 122 by product conveyor 118. End wall 102 moves to accommodate the building product load 122, as illustrated by bucket 96A of FIG. 8, with wall 102 retreating and supporting the load continually. When the product load 122 has been completely inserted into a product bucket, such as product bucket 96B, the product bucket then passes to a position adjacent a cartoner 110 and open product cartons 111, as illustrated by product bucket 96C. The end wall moving mechanism, such as a cam device as described herein above for the leaflet inserter, engages the cam following pin 106 of the end wall 102 and moves the end wall to eject the product load 122 as the product buckets move adjacent produce cartons 111.

Figure 10:
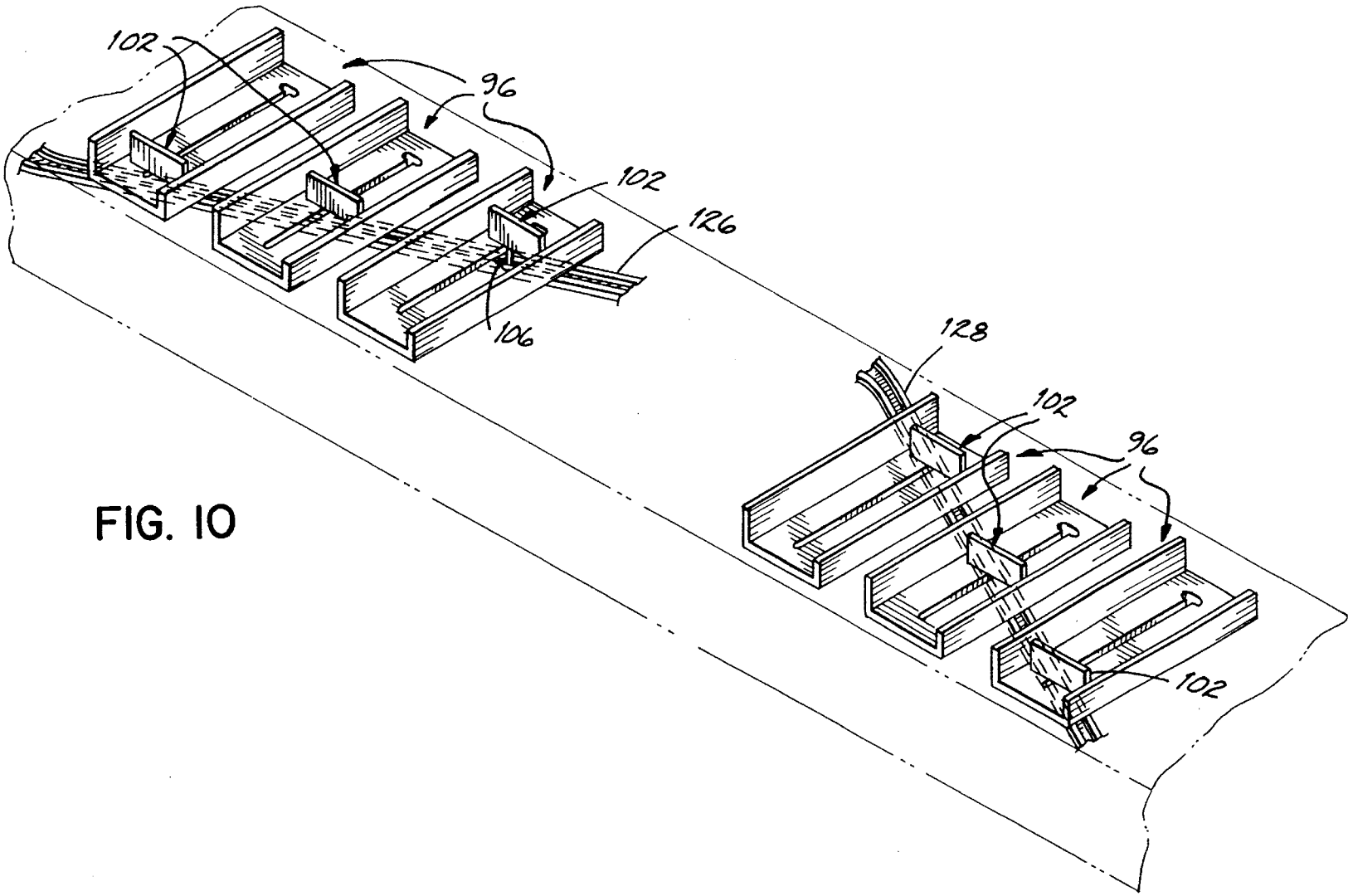

FIG. 10 illustrates the cam operations of wall 102 in this regard. As illustrated by the bucket 96D, the end wall 102 moves toward the forward end of bucket 96D and begins to eject the product load 122 into a product carton 111. When the product bucket reaches the end of the integrated product bucket loader 120, the end wall 102 is preferably at its endmost position to completely eject the product load 122 into the product carton 111, as illustrated by bucket 96E. The integrated product bucket loader 120 might utilize a guide similar to the guide 90 discussed hereinabove with respect to the leaflet inserter in order to return the end walls 102 to their rearwardmost positions, thereby preparing the bucket 96 to receive another product load. Alternatively, a cam structure to might be utilized to direct the end wall 102 in order to progressively build a product load as the product buckets 96 move past the product conveyor 118.

Figure 9:
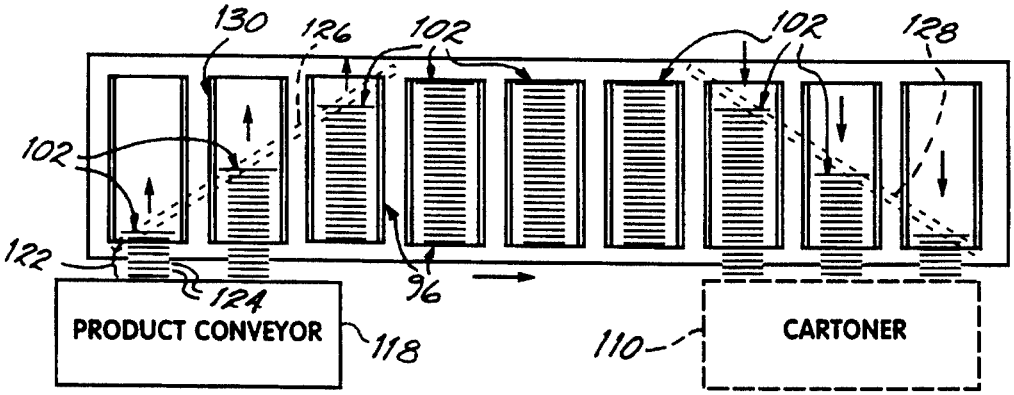
FIG. 9 is a diagrammatic view similar to FIG. 8 illustrating load building in an integrated bucket loader; and, FIG. 10 is a perspective view illustrating product buckets of the present invention and movement of the bucket wall by an underlying cam.

Referring now to FIG. 9, each product load 122 might include individual packets of material 124. Individual packets 124 must be stacked side by side within the product bucket 96 and subsequently ejected into a product carton. When building product loads comprising individual packets of material, the packets of material have a tendency to fall over within the product buckets so that they are not neatly stacked side by side. Such uneven stacking increases the complexity of the equipment necessary to build such loads, and also increases the amount of time spent in the packaging process. The integrated product bucket loader 120 of the present invention prevents tipping of the product package by providing a movable end wall 102 which accommodates the building of virtually any size load. As illustrated in FIG. 9, a second cam 126 is provided, which controls movement of the end wall 102 rearwardly as a product load 122 is being built by the product conveyor 118. The cam acts appropriately against the pin 106 to control the building of the product load and to support the packets 124 in an upright position. Thus, the packets 124 may be pressed against the end wall 102, which will hold the packets in an upright position as the product load is being built to prevent tipping and jamming within the product bucket 96.

The cam angle is of course a function of the bucket speed in the machine direction of the product infeed rate. Cam 126 may be similar to the cam 128, disposed, however, in different directions, and which is utilized to eject the product loads into product cartons as discussed herein above with respect to the leaflet inserter of the present invention. Cam 126 is located in a fill run, of the buckets, and cam 128 is located in a discharge run of the buckets.

The integrated bucket loader 120, in accordance with the principles of the present invention, utilizes the product load receiving buckets 96 with movable end walls which move to one side as the buckets move through an upstream fill run to accept product loads being built and then move in an opposite transverse direction as the buckets move through a discharge run to eject the product loads such as into product cartons. Furthermore, the product buckets 96 of the present invention may accommodate product loads which do not completely fill the product bucket. For example, cam 126 might be angled so that end wall 96 only moves to a final position half way along the length of the product bucket as illustrated by product bucket 130 in FIG. 9. In that way, the product load receiving buckets of the present invention may be utilized with a number of different size loads to effectively build the load, transfer the load, and eject the load into a product carton. This further eliminates the necessity of changing the product bucket size when various different sized loads are utilized. In this regard the underlying cam may comprise a track fully capturing the pin to positively locate wall 102 through out its range of motion. Also it will be appreciated that the cams 126, 128 can be oriented in a variety of suitable directions with appropriate guides or cams (not shown) between them for positive pin control.

While the present invention has been illustrated by the description of the embodiments thereof, and while the embodiments have been described in considerable detail, it is not the intention of applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of applicants' general inventive concept.

We claim:

1. An apparatus for inserting a leaflet into a product carton or a product bucket, said apparatus comprising:

at least one leaflet tray having a bottom wall and configured for receiving a leaflet and being movably mounted for synchronizing with one of a product carton or bucket;

a leaflet pusher slidably mounted on the bottom wall of said leaflet tray, the pusher mounted to slide in the longitudinal guide slot formed in the bottom wall for transverse movement across the tray;

a pusher activating apparatus operating in a timed sequence with the movement of the tray to slide the leaflet pusher in the slot across the tray;

the leaflet pusher configured to engage said tray bottom wall when sliding thereon and scrape the bottom wall to push a generally flat leaflet out of the tray and insert the leaflet into one of said carton or bucket as the tray moves along therewith.

2. The apparatus of claim 1 further comprising a continuous conveyor with a plurality of adjacent trays for sequentially receiving said generally flat leaflets.

3. The apparatus of claim 2 further comprising a guide positioned proximate the conveyor for engaging the leaflet pusher at a position along the conveyor and for sliding the leaflet pusher back across the tray for receipt of another leaflet.

4. The apparatus of claim 1 wherein the leaflet pusher includes upper and lower lugs positioned on opposite sides of the tray for holding the pusher on the tray and within the slot.

5. The apparatus of claim 4 wherein said upper lug rests on said bottom wall and scrapes the wall when the leaflet pushers slides across the tray.

6. The apparatus of claim 4 further comprising a release opening formed in the tray proximate an end of the slot, the lower lug configured to pass through the slot when aligned therewith for releasing the leaflet pusher from the tray.

7. The apparatus of claim 1 wherein the leaflet pusher includes a cam following pin and the pusher activating mechanism includes a cam track for engaging the pin and sliding the leaflet pusher to scrape the tray bottom wall and insert a leaflet.

8. The apparatus of claim 7 wherein the cam track is generally linear and is angled with respect to the direction of movement of the tray for sliding the leaflet pusher transversely across the tray.

9. The apparatus of claim 8 wherein the cam track is movable for adjusting the angle of the track with respect to the direction of movement of the tray for accommodating leaflets of varied lengths.

10. The apparatus of claim 1 further comprising a cartoning apparatus positioned proximate the leaflet tray for moving a carton adjacent and in synchronism with the tray such that a leaflet may be dispensed generally laterally from the tray into the carton.

11. The apparatus of claim 1 further comprising a leaflet loader for operatively delivering a leaflet into the tray to lie generally flat on the bottom wall of said tray such that the leaflet may be scraped therefrom by said pusher.

12. The apparatus of claim 11 wherein the leaflet loader includes at least one downwardly-sloped finger for guiding a leaflet and a moving friction member which frictionally engages the finger and forces the leaflet along the finger and into the tray.

13. The apparatus of claim 12 wherein the leaflet tray includes a groove formed at one side thereof for receiving the finger during loading of the leaflet.

14. A leaflet transfer apparatus for receiving a leaflet in a machine direction and for transferring leaflets in a direction transverse to said machine direction said apparatus comprising:

a plurality of conveyor mounted leaflet tray, each having a bottom wall;

a leaflet pusher slidably mounted on the bottom wall of each of said trays, the pusher mounted to slide in a longitudinal guide slot formed in the bottom wall for movement thereacross in said transverse direction;

a cam follower operably connected to each of said pushers; and, a cam for engaging said followers and sliding said pushers transversely, the leaflet inserters configured to engage said bottom walls when sliding thereon and scrape the bottom walls to push generally flat leaflets in the trays and discharge the leaflets transversely from said trays as said trays move in said machine direction.

15. The apparatus of claim 14 including a leaflet loader for introducing leaflets onto said trays in said machine direction to lie generally flat on the bottom wall of said tray such that the leaflet may be scraped therefrom by said pusher.

16. The apparatus of claim 14 including at least one of a plurality of product buckets or a plurality of product cartons disposed in operative alignment with said trays when said cam followers are operated by said cam for receiving leaflets discharged from said trays on the fly.

17. An apparatus for transferring variable loads of a product and discharging the product loads along a machine path and comprising:

at least one movably mounted product load:receiving bucket having a bottom wall end configured to receive a product load;

an integrated movable end wall slidably mounted on the bucket for movement along the bucket on the bottom wall, the end wall mounted to move in a longitudinal guide slot formed in the bottom wall and having a cam-following pin depending from said end wall below the bucket bottom wall, the end wall movable in a first direction for expanding the bucket capacity and receiving a product load, and movable in a second opposite direction to decrease the bucket capacity and discharge the product load;

a first cam track for engaging said cam-following pin and said movable end wall at a first position along the machine path and operable for moving the endwall in said first direction to expand the bucket capacity;

a device for manipulating a product load and gradually building said product load in the bucket as the bucket capacity expands; and, a second cam track for engaging the cam-following pin and movable end wall at a second position along the machine path located down the machine path from said first position, the second cam operable for moving the end wall in the second direction to decrease the bucket capacity and discharge the product load from the bucket.

18. The apparatus of claim 17 further comprising a conveyor with a plurality of adjacent conveyor mounted buckets for sequentially building and discharging product loads.

19. The apparatus of claim 17 wherein at least one of the cam tracks is generally linear and is angled with respect to the direction of movement of the bucket for sliding the end wall transversely across the bucket.

20. The apparatus of claim 19 wherein said linear cam track is movable to adjust the angle of the track with respect to the direction of movement of the bucket and for varying the effective rate at which the bucket capacity is one of expanded and decreased.

21. The apparatus of claim 17 further comprising a cartoning apparatus positioned proximate the product bucket for introducing cartons alongside adjacent buckets such that a product load may be inserted generally laterally from a bucket into a carton,

22. A method for transferring variable loads of a product comprising:

conveying at least one product bucket having a bottom wall on a packaging path, the bucket having an integrated movable end wall mounted on the bucket for sliding in a longitudinal guide slot formed in the bottom wall for movement across the bucket to vary the capacity of the bucket;

loading product into the bucket at a first position along the packaging path and simultaneously moving the movable end wall toward one end of the bucket to gradually and simultaneously expand the capacity of the bucket for receiving product as it is loaded into the bucket; and, moving the end wall toward the other end of the bucket at a second subsequent position along the packaging path to reduce the capacity of the bucket and eject the product out of the bucket.

23. The method of claim 22 wherein the movable end wall includes a cam following pin, the method further comprising engaging the pin with a cam track as the bucket is conveyed to move the end wall across the bucket.

24. The method of claim 23 further comprising adjusting the angle of the cam track with respect to the packaging path to vary the rate at which the end wall is moved as the bucket is conveyed along the path to vary the rate at which the bucket capacity is expanded and reduced.

25. The method of claim 22 further comprising conveying a plurality of products in buckets on the path, each bucket having a movable end wall therein, and respectively moving the end walls increasing distances in the buckets as the buckets move along the path such that the end wall of one bucket is disposed a greater distance toward a discharge end of the bucket than the end wall in a following adjacent product bucket to gradually discharge the product from the bucket.

26. The method of claim 22 wherein the movable end wall includes a cam following pin, the method further comprising:

engaging the pin with a first cam as the bucket is moved along the first position of the packaging path, the first cam oriented to move the pin and end wall toward one end of the bucket; and engaging the pin with another cam when the bucket is moved along the second path position next to a carton, the second cam oriented in another direction to move the end wall toward the other end of the bucket to discharge the product from the bucket.

27. A method for inserting a leaflet into at least one of a product carton or a product bucket comprising:

conveying at least one leaflet tray having a bottom wall on a path, the tray having a leaflet pusher slidably mounted on the bottom wall of said tray, the pusher mounted to slide in a longitudinal guide slot formed in the bottom wall for transverse movement across the tray;

loading a leaflet into the tray at a position along the path so that the leaflet lies generally flat on said bottom wall;

presenting one of a product carton or a product bucket adjacent to the tray at a position along the path;

moving the leaflet pusher in the tray such that the leaflet pusher scrapes the tray bottom wall and pushes the leaflet out of the tray and into the carton or bucket.

28. The method of claim 27 wherein the leaflet tray is continuously conveyed along the path, the method further comprising returning the leaflet pusher back across the tray to prepare the tray to receive another leaflet.

29. The method of claim 27 wherein the leaflet pusher includes a cam following pin, the method further comprising engaging the pin with a cam track as the tray is conveyed to move the leaflet pusher.

30. The method of claim 29 further comprising adjusting the angle of the cam track with respect to the path to vary the rate at which the leaflet pusher scrapes the tray bottom wall as the tray is conveyed along the path.

31. The method of claim 27 further comprising conveying a plurality of adjacent trays along the path, each tray having a leaflet pusher therein, and moving the leaflet pushers increasing distances across the trays as the trays move along the path such that the leaflet pusher of one tray is moved a greater distance than the leaflet pusher in a following adjacent tray to gradually scrape the tray bottom wall and insert the leaflets into the carton or bucket.

* * * * *

UNITED STATES PATENT AND TRADEMARK OFFICE

CERTIFICATE OF CORRECTION

PATENT NO. : 5,551,217

DATED : September 3, 1996

INVENTOR(S) : William Albert Huening and Richard Edward Radigan

It is certified that error appears in the above-indentified patent and that said Letters Patent is hereby corrected as shown below:

In Column 13, line 20, "load: receiving" should be --load-receiving--.

In Column 13, line 21, "wall end" should be --wall and--.

Signed and Sealed this

Twenty-fifth Day of February, 1997

*Attest:*

*Attesting Officer*

BRUCE LEHMAN

*Commissioner of Patents and Trademarks*